United States Patent [19]

Hattori

[11] Patent Number: 5,001,761

[45] Date of Patent: Mar. 19, 1991

[54] DEVICE FOR NORMALIZING A SPEECH SPECTRUM

[75] Inventor: Hiroaki Hattori, Tokyo, Japan

[73] Assignee: NEC Corporation, Tokyo, Japan

[21] Appl. No.: 308,905

[22] Filed: Feb. 8, 1989

[30] Foreign Application Priority Data

Feb. 9, 1988 [JP] Japan ..... 63-29676
Feb. 9, 1988 [JP] Japan ..... 63-29677

[51] Int. Cl.[5] ..... G10L 3/02; G10L 5/00
[52] U.S. Cl. ..... 381/46
[58] Field of Search ..... 381/29–40, 381/46, 47, 71

[56] References Cited

U.S. PATENT DOCUMENTS 4,490,839 12/1984 Bunge ..... 381/47
4,683,590 7/1987 Miyoshi et al. ..... 381/71
4,852,181 7/1989 Morito et al. ..... 381/46

*Primary Examiner*—Dale M. Shaw
*Assistant Examiner*—David D. Knepper
*Attorney, Agent, or Firm*—Sughrue, Mion, Zinn, Macpeak & Seas

[57] ABSTRACT

A device for use in a speech recognizer or similar apparatus for normalizing the spectrum of speech as preprocessing for speech recognition. The device divides the spectrum of input speech at a predetermined frequency and determines a linear approximate line for each of the divided spectra such that the resulting approximate lines join each other at the point of division, thereby normalizing the spectrum.

6 Claims, 5 Drawing Sheets

DEVICE FOR NORMALIZING A SPEECH SPECTRUM

BACKGROUND OF THE INVENTION

The present invention relates to a device for use in a speech recognizer or similar apparatus for normalizing the spectrum of speech.

Recognition of speech in noisy environments is extremely difficult because noise not only masks speech but also causes the utterance itself to change due to the Lombard effect, as well known in the art. The Lombard effect stems from the fact that a person speaking in a noisy environment tends to speak louder and more clearly because the speakers words themselves are hard to distinguish. The spectrum of speech in a noisy condition has greater total energy than and a different shape from the spectrum of speech spoken by the same speaker in a quiet environment.

Implementations for normalizing the spectrum of speech, i.e., correcting the spectral shape are disclosed by Miwa et al in a paper entitled "Investigation on Interspeaker Normalization for Speech Recognition", PROC. of Acoustical Society of Japan, 3-2-1, pp. 577–578, June 1979 (referred to as Prior Art 1 hereinafter), and by David B. Roe in a paper entitled "ADAPTATION OF A SPEECH RECOGNIZER TO THE LOMBARD EFFECT IN HIGH NOISE CONDITIONS" IEICE Technical Report SP86-66, 1986 (referred to as Prior Art 2 hereinafter). Prior Art 1 is directed toward the recognition of speeches of unspecified talkers.

For example, the spectrum normalizing method proposed in Prior Art 1 compensates for the influence of vocal path length which depends upon the individual, i.e., it normalizes linear influence with respect to the logarithmic frequency axis. However, the Lombard effect results in a substantial increase of energy in a certain range of speech frequencies, and the influence of such an increase of energy is non-linear to logarithmic frequency axis. This prior art method, therefore, is incapable of sufficiently normalizing the Lombard effect.

SUMMARY OF THE INVENTION

It is therefore an object of the present invention to provide a spectrum normalizing device for use in a speech recognizer or similar apparatus for performing the recognition of a speech spectrum as preprocessing for speech recognition.

It is another object of the present invention to provide a generally improved spectrum normalizing device.

In accordance with the present invention, there is provided a device for normalizing a spectrum of speech, comprising a spectrum analyzing section for analyzing input speech to calculate a spectrum of the speech, a frequency storing section for storing a predetermined frequency beforehand, an approximate line calculating section for dividing the spectrum at the predetermined frequency and determining approximate lines for each of the divided spectra such that resulting approximate lines join each other at the predetermined frequency, and a spectrum normalizing section for normalizing the spectrum by using the approximate lines.

In accordance with the present invention, there is also provided a device for normalizing a spectrum of speech, comprising a spectrum analyzing section for analyzing input speech to calculate a spectrum of the speech, a division frequency determining section for determining a frequency which gives a maximum value of the spectrum, an approximate line calculating section for dividing the spectrum at the frequency and determining an approximate line for each of the divided spectra such that resulting approximate lines join each other at the frequency, and a spectrum normalizing section for normalizing the spectrum by using the approximate lines.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a brief reference will be made to a prior art spectrum normalizing device.

Figure 1:
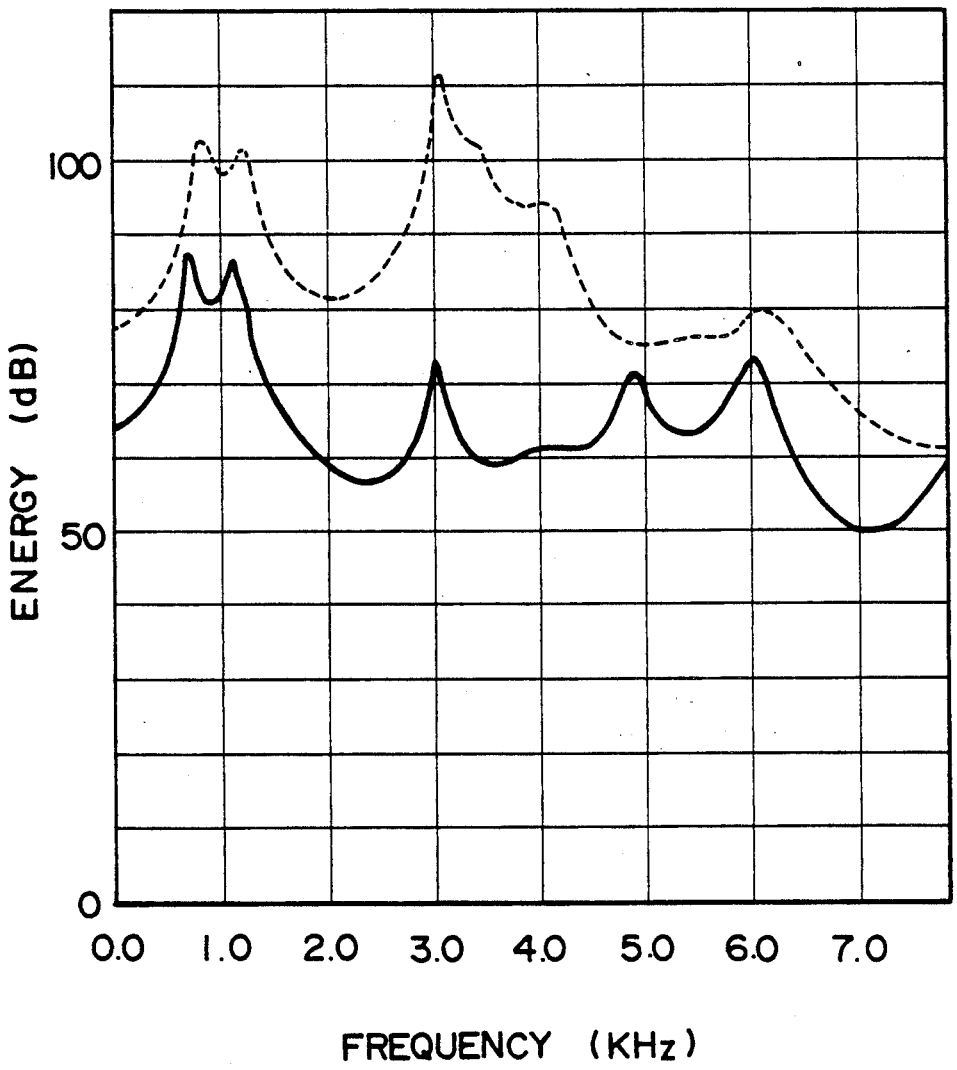
FIG. 1 is a plot showing a speech spectrum in a quiet condition and a speech spectrum in a noisy condition.

In FIG. 1, there are shown the spectra of vowel /a/ which were individually observed in a quiet condition and a noisy condition and spoken by the same speaker. Specifically, a solid line and a dotted line in the figure are associated with the quiet condition and the noisy condition, respectively. As shown, the utterance in a noisy condition not only has higher total energy but also has a different spectral shape from the utterance in a quiet condition.

Figure 2:
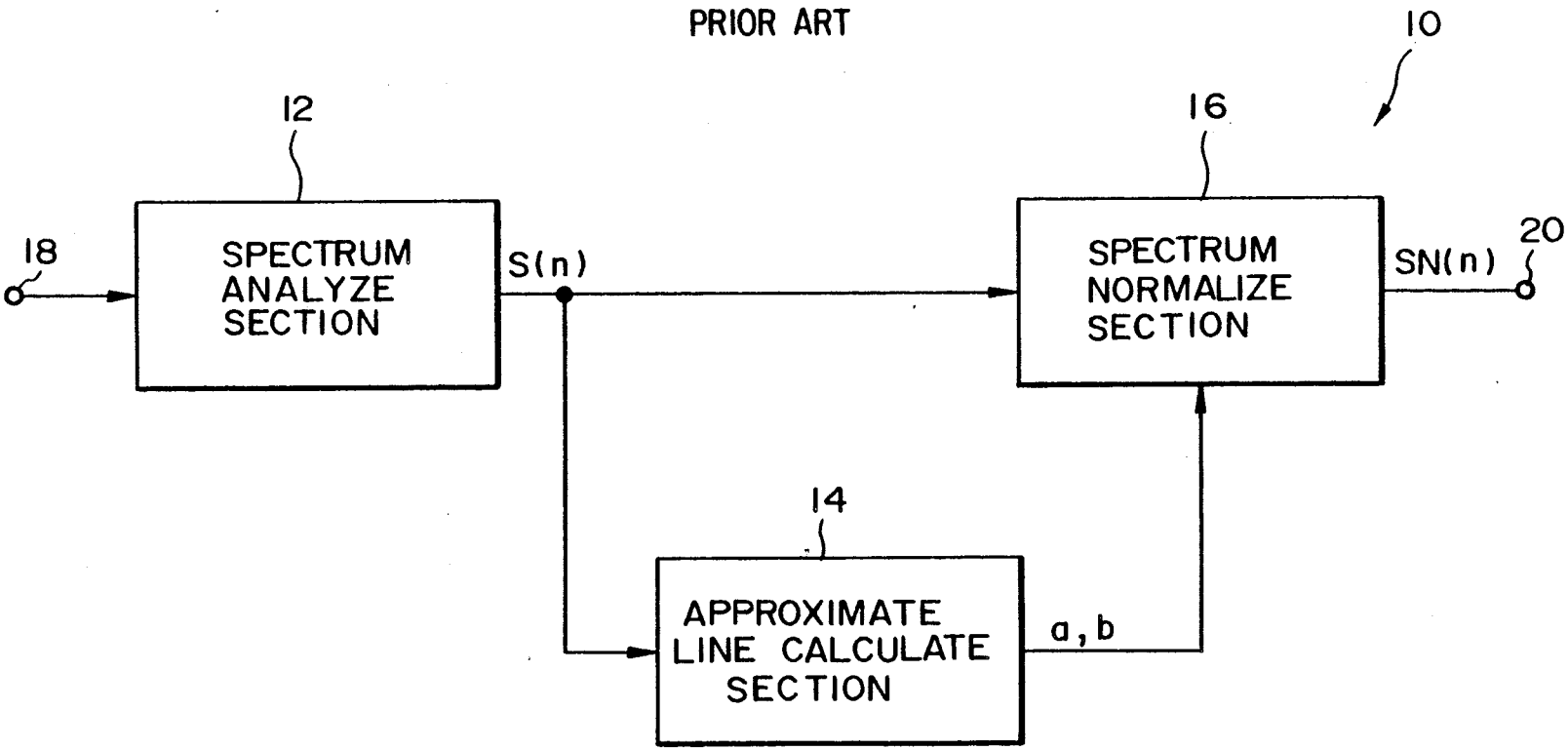
FIG. 2 PRIOR ART
FIG. 2 is a block diagram schematically showing a prior art spectrum normalizing device.

A reference will be made to FIG. 2 for describing the spectrum normalizing method which is taught in Prior Art 1. In FIG. 2, a spectrum normalizing device 10 is generally made up of a spectrum analyzing section 12, an approximate line calculating section 14, and a spectrum normalizing section 16. When speech is applied to an input terminal 18, the spectrum analyzing section 12 receives it and analyzes it by using a group of band filters (twenty-nine channels, center frequency of 250 kHz to 6300 Hz, intervals of 1/6 octave, Q of 6, and no broad-band emphasis), thereby producing a speech spectrum $\{S(n), n=1, 29\}$ every 10 seconds. This speech spectrum is expressed by lograrithm with respect to both amplitude and frequency. Receiving the speech spectrum, the approximate line calculating section 14 calculates an approximate line $N(n)=a\times n+b$ which gives a minimum square error and then outputs the coefficients a and b. The spectrum normalizing section 16 receives the speech spectrum $\{S(n), n=1, 29\}$ from the analyzing section 12 and the coefficients a and b of the approximate line from the calculating section 14. The normalizing section 16 therefore determines a normalized spectrum $\{SN(n), n=1, 29\}$ by performing an equation $SN(n)=S(n)-a\times b-b$, the resulting spectrum being fed to an output terminal 20.

The prior art implementation described above is elaborated to compensate for the influence of vocal path length which differs from one person to another by normalizing the linear influence with respect to logarithmic frequency axis. However, as shown in FIG. 1, the Lombard effect is observed in the form of a noticeable increase of energy in the frequency range of 2.5 kHz to 4 kHz, and the influence of such an increase is non-linear to the logarithmic frequency axis. Therefore, sufficient approximation is not achievable with the prior art linear equation.

Preferred embodiments of the present invention which solve the problem discussed above will be described in detail hereinafter.

FIRST EMBODIMENT

Figure 5A:
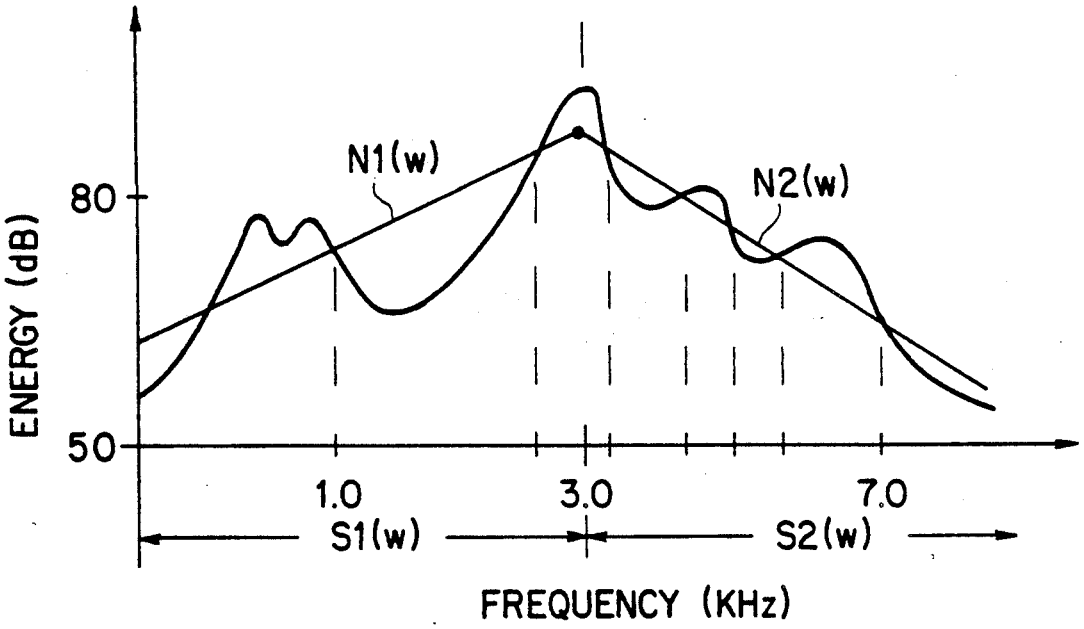
FIG. 5A illustrates the division of the input spectrum and curve fitting in accordance with equations (1)–(4) and FIG. 5B illustrates the spectrum normalization in accordance with equations (5) and (6).

Briefly, a first embodiment of the present invention divides a speech spectrum at a predetermined frequency, determines a linear approximate line for each of the divided spectra such that the approximate lines meet each other at the point of division, and thereby normalizes the spectrum. In detail, assuming a spectrum $S(\omega)$ obtained from speech, the spectrum $S(\omega)$ is divided at a predetermined frequency of $\omega c$ into spectra $\{S1(\omega), \omega<\omega c\}$ and $\{S2(\omega), \omega\geqq\omega c\}$. Then, approximate lines individually associated with the divided spectra $S1(\omega)$ and $S2(\omega)$ are produced by (see FIG. 5A):

$$N1(\omega)=a1\times\omega+b1 \quad \text{Eq. (1)}$$

$$N2(\omega)=a2\times\omega+b2 \quad \text{Eq. (2)}$$

At this instant, in order to prevent the approximate lines from becoming discontinuous at the point of division, a particular condition is added as follows:

$$a1\times\omega c+b1=a2\times\omega c+b2 \quad \text{Eq. (3)}$$

The coefficients a1, a2, b1 and b2 included in the above Eqs. (1) to (3) are produced by using the Eq. (3) and an Eq. (4) which is representative of square error as shown below:

$$\epsilon=\{S1(\omega)-N1(\omega)\}^2d\omega+\{S2(\omega)-N2(\omega)\}^2d\omega \quad \text{Eq. (4)}$$

A normalized spectrum $SN(\omega)$ is expressed as:

$$SN(\omega)=S1(\omega)-N1(\omega)\omega<\omega c \quad \text{Eq. (5)}$$

$$SN(\omega)=S2(\omega)-N2(\omega)\omega\geqq\omega c \quad \text{Eq. (6)}$$

Figure 5B:
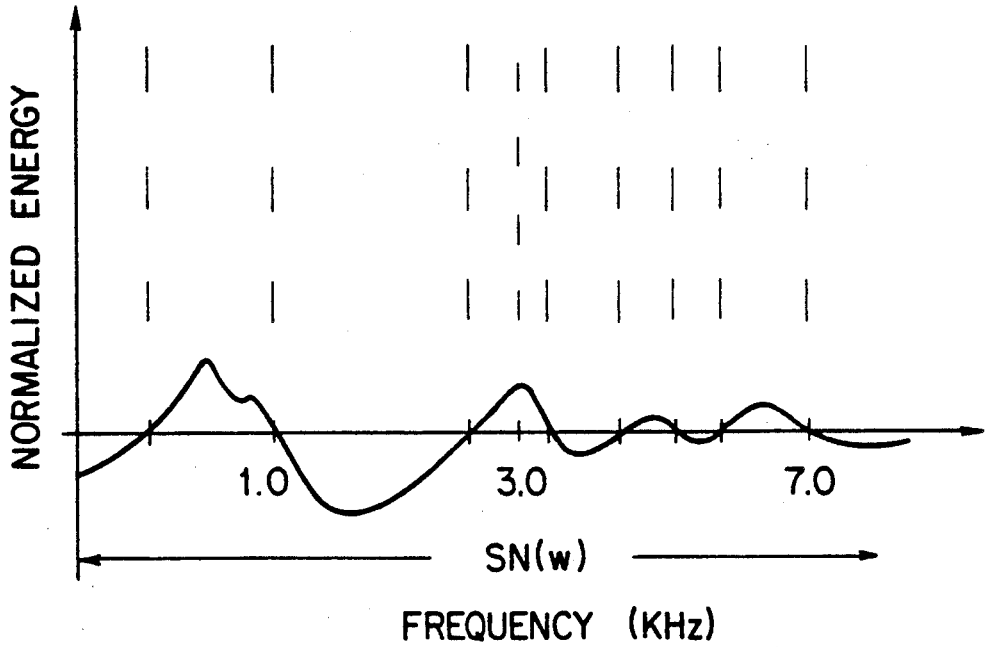

By the procedure stated above, normalization of the deformation of a spectrum, i.e., increase of energy at and around a certain frequency as observed with the Lombard effect and which has been impractical with the prior art using a minimum square line is implemented (see FIG. 5B).

Figure 3:
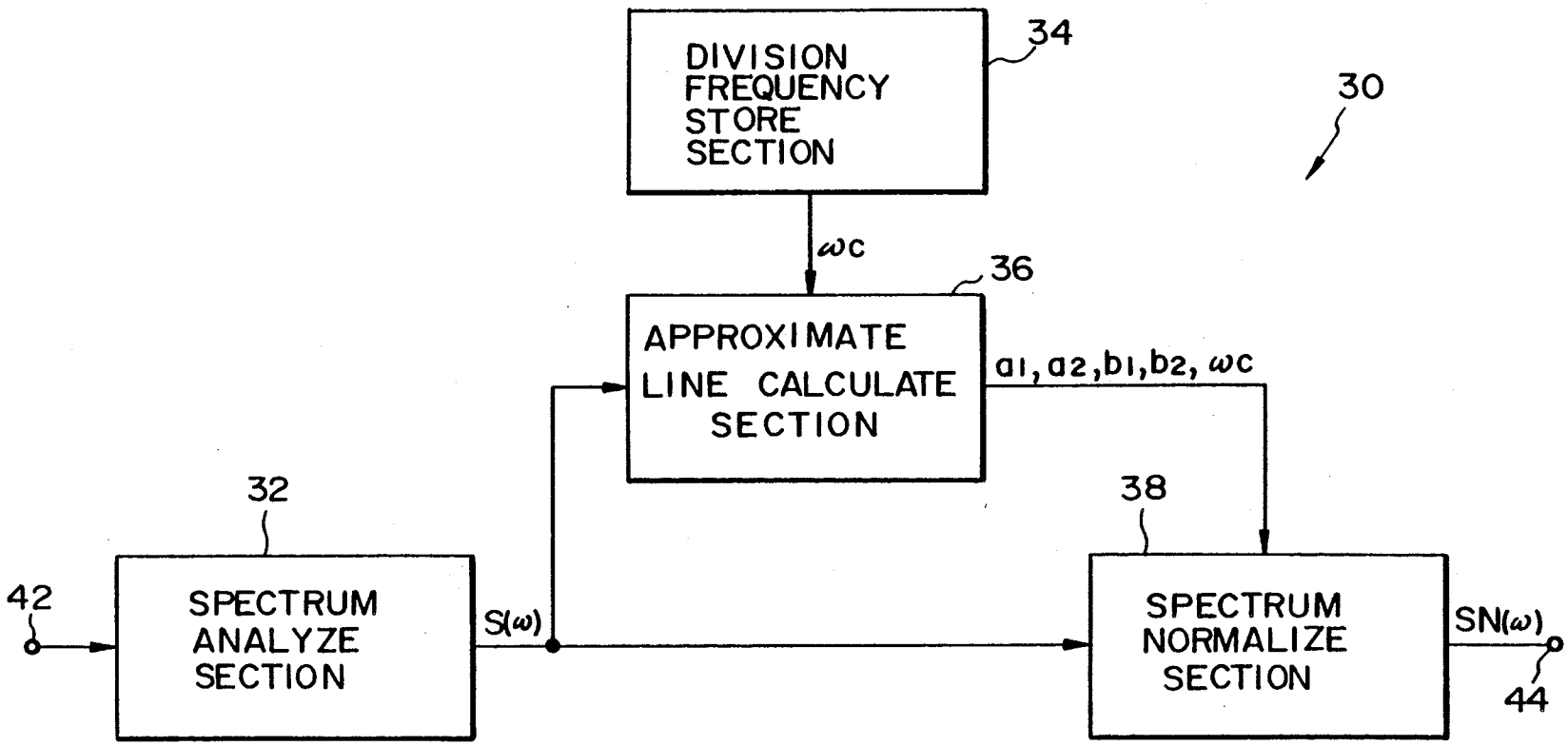
FIG. 3 is a block diagram schematically showing a spectrum normalizing device embodying the present invention.

FIG. 3 shows a construction for implementing the above-described principle of the first embodiment. In the figure, a spectrum normalizing device 30 is constituted by a spectrum analyzing section 32, a division frequency storing section 34, an approximate line calculating section 36, and a spectrum normalizing section 38.

In operation, as speech is applied to an input terminal 42 of the device 30, the spectrum analyzing section 32 calculates a spectrum $S(\omega)$ of the speech. Specific constructions of the spectrum analyzing section 32 are shown and described in the previously mentioned Prior Arts 1 and 2. The approximate line calculating section 36 receives the speech spectrum $S(\omega)$ from the analyzing section 32, reads a division frequency $\omega c$ stored beforehand in the storing section 34, and divides the spectrum $S(\omega)$ at the division frequency $\omega c$ into spectra $S1(\omega)$ and $S2(\omega)$. Then, the calculating section 36 determines the coefficients a1, a2, b1 and b2 of the Eqs. (1) and (2) which are individually representative of linear approximate lines associated with the spectra $S1(\omega)$ and $S2(\omega)$, under the condition defined by the Eq. (3) and such that the square error of Eq. (4) becomes minimum. The determined coefficients a1, a2, b1 and b2 and the division frequency $\omega c$ are fed to the spectrum normalizing section 38. Concerning the division frequency $\omega c$, in the case of normalization of the Lombard effect, the frequency may be selected from a range of 2.5 kHz to 4 kHz because the center of increase of spectrum will lie in such a frequency range. The normalizing section 38 receives the coefficients a1, a2, b1 and b2 and the division frequency $\omega c$ from the calculating section 36 and the speech spectrum $S(\omega)$ from the analyzing section 32, and produces a normalized spectrum $SN(\omega)$ by substituting such inputs for the Eqs. (5) and (6), and delivers it to an output terminal 44.

SECOND EMBODIMENT

Generally, a second embodiment of the present invention divides a spectrum at a frequency which gives the maximum value of the spectrum, determines a linear approximate line for each of the divided spectra such that the resulting approximate lines join each other at the point of division, and thereby normalizes the spectrum. Assuming a spectrum $S(\omega)$ obtained from speech, a frequency $\omega c$ which gives the maximum value of the spectrum $S(\omega)$ is produced by:

$$\omega c=\text{argmax}\{S(\omega)\} \quad \text{Eq. (7)}$$

where $\omega c=\text{argmax}\{\ \}$ is representative of the frequency which makes the spectrum $S(\omega)$ maximum. The spectrum $S(\omega)$ is divided into spectra $\{S1(\omega), \omega<\omega c\}$ and $\{S2(\omega), \omega\geqq\omega c\}$ at the obtained frequency $\omega c$. Approximated lines individually associated with the spectra $S1(\omega)$ and $S2(\omega)$ are produced by:

$$N1(\omega)=a1\times\omega+b1 \quad \text{Eq. (8)}$$

$$N2(\omega)=a2\times\omega+b2 \quad \text{Eq. (9)}$$

At this instant, in order to prevent the approximate lines from becoming discontinuous at the point of division, a particular condition is added as follows:

$$a1\times\omega c+b1=a2\times\omega c+b2 \quad \text{Eq. (10)}$$

The coefficients a1, a2, b1 and b2 included in the above Eqs. (8) to (10) are produced by using the Eq. (10) and an Eq. (11) which is representative of square error as shown below:

$$\epsilon=\{S1(\omega)-N1(\omega)\}^2d\ \omega+\{S2(\omega)-N2(\omega)\}^2d\omega \quad \text{Eq. (11)}$$

A normalized spectrum $SN(\omega)$ is expressed as:

$$SN(\omega)=S1(\omega)-N1(\omega)\omega<\omega c \quad \text{Eq. (12)}$$

$$SN(\omega)=S2(\omega)-N2(\omega)\omega\geqq\omega c \quad \text{Eq. (13)}$$

By the procedure stated above, normalization of the deformation of a spectrum, i.e., increase of energy at and around a certain frequency as observed with the Lombard effect and which has been impractical with the prior art using a minimum square line is implemented.

Figure 4:
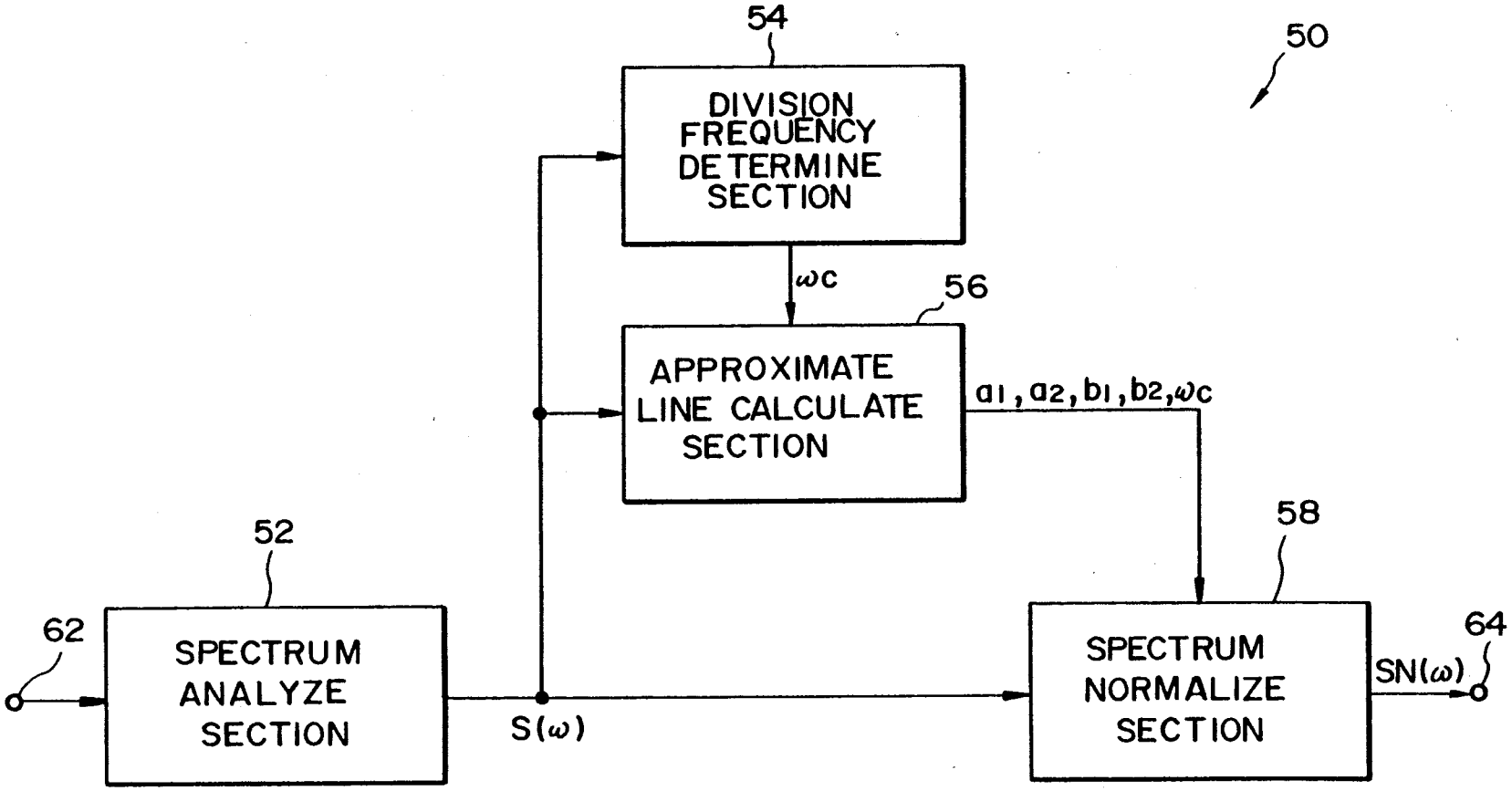
FIG. 4 is a view similar to FIG. 3, showing an alternative embodiment of the present invention.

Referring to FIG. 4, a construction for implementing the above-described principle of the second embodiment is shown. In the figure, a spectrum normalizing device 50 is constituted by a spectrum analyzing section 52, a division frequency determining section 54, an approximate line calculating section 56, and a spectrum normalizing section 58.

In operation, as speech is applied to an input terminal 62 of the device 50, the spectrum analyzing section 52 calculates a spectrum S ($\omega$) of the speech. Again, specific constructions of the spectrum analyzing section 52 are shown and described in the previously mentioned Prior Arts 1 and 2. The division frequency determining section 54 receives the speech spectrum S ($\omega$) from the analyzing section 52, and produces a frequency $\omega c$ which gives the maximum value of the spectrum S ($\omega$). Receiving the spectrum S ($\omega$) and the frequency $\omega c$, the calculating section 56 divides the spectrum S ($\omega$) at the frequency $\omega c$ and determines the coefficients a1, a2, b1 and b2 of the Eqs. (8) and (9) which are individually representative of linear approximate lines associated with the spectra S1 ($\omega$) and S2 ($\omega$), under the condition defined by the Eq. (10) and such that the square error of Eq. (11) becomes minimum. The determined coefficients a1, a2, b1 and b2 and the frequency $\omega c$ are fed to the spectrum normalizing section 58. Concerning the division frequency $\omega c$, in the case of normalization of the Lombard effect, the frequency may be selected from a range of 2.5 kHz to 4 kHz because the center of increase of spectrum will lie in such a frequency range. The normalizing section 58 receives the coefficients a1, a2, b1 and b2 and the division frequency $\omega c$ from the calculating section 56 and the speech spectrum S ($\omega$) from the analyzing section 52, produces a normalized spectrum SN ($\omega$) by substituting such inputs for the Eqs. (12) and (13), and delivers it to an output terminal 64.

In summary, it will be seen that the present invention provides a spectrum normalizing device capable of accurately normalizing even a speech spectrum which has been effected non-linearly with respect to the frequency axis.

Various modifications will become possible for those skilled in the art after receiving the teachings of the present disclosure without departing from the scope thereof.

What is claimed is:

1. A device for normalizing a spectrum of speech, comprising:

spectrum analyzing means for analyzing input speech to calculate a spectrum of the speech;

frequency storing means for storing a predetermined frequency beforehand;

approximate line calculating means for dividing the spectrum at the predetermined frequency and determining approximate lines for each of the two divisions of the sampled spectrum such that resulting approximate lines join each other at the predetermined frequency; and spectrum normalizing means for normalizing the spectrum by using the approximate lines.

2. A device as claimed in claim 1, wherein assuming that the spectrum is S ($\omega$), the predetermined frequency is $\omega c$, and the divided spectra are S1 ($\omega$) (where $\omega < \omega c$) and S2 ($\omega$) (where $\omega \geqq \omega c$), the approximate lines individually associated with the spectra S1 ($\omega$) and S2 ($\omega$) are expressed as:

$$N1(\omega) = a1 \times \omega + b1$$

$$N2(\omega) = a2 \times \omega + b2$$

and a condition for the approximate lines to join each other is:

$$a1 \times \omega c + b1 = a2 \times \omega c + b2$$

coefficients a1, a2, b1 and b2 being produced by the above equation which causes the approximate lines to join and a condition which makes an equation representative of a square error as shown below minimum:

$$\epsilon = \{S1(\omega) - N1(\omega)\}^2 d\omega + \{S2(\omega) - N2(\omega)\}^2 d\omega.$$

3. A device as claimed in claim 2, wherein assuming that a normalized spectrum is SN ($\omega$), SN ($\omega$) is produced by:

$$SN(\omega) = S1(\omega) - N1(\omega) \text{ (where } \omega < \omega c\text{), and}$$

$$SN(\omega) = S1(\omega) - N2(\omega) \text{ (where } \omega \geqq \omega c\text{).}$$

4. A device for normalizing a spectrum of speech, comprising:

spectrum analyzing means for analyzing input speech to calculate a spectrum of the speech;

division frequency determining means for determining a frequency which gives a maximum value of the spectrum;

approximate line calculating means for dividing the spectrum at the frequency and determining an approximate line for each of the two divisions of the sampled spectrum such that resulting approximate lines join each other at the determined frequency; and spectrum normalizing means for normalizing the spectrum by using the approximate lines.

5. A device as claimed in claim 4, wherein assuming that the spectrum is S ($\omega$), the frequency which gives the maximum frequency of the spectrum S ($\omega$) is $\omega c$, and the divided spectra are S1 ($\omega$) (where $\omega < \omega c$) and S2 ($\omega$) (where $\omega \geqq \omega c$), the approximate lines individually associated with the spectra S1 ($\omega$) and S2 ($\omega$) are expressed as:

$$N1(\omega) = a1 \times \omega + b1$$

$$N2(\omega) = a2 \times \omega + b2$$

and a condition for the approximate lines to join each other is:

$$a1 \times \omega c + b1 = a2 \times \omega c + b2$$

coefficients a1, a2, b1 and b2 being produced by the above equation which causes the approximate lines to join and a condition which makes an equation representative of a square error as shown below minimum:

$$\epsilon = \{S1(\omega) - N1(\omega)\}^2 d\omega + \{S2(\omega) - N2(\omega)\}^2 d\omega.$$

6. A device as claimed in claim 5, wherein assuming that a normalized spectrum is SN ($\omega$), SN ($\omega$) is produced by:

$$SN(\omega)=S1(\omega)-N1(\omega) \text{ (where } \omega<\omega c\text{), and}$$

$$SN(\omega)=S1(\omega)-N2(\omega) \text{ (where } \omega\geqq\omega c\text{).}$$

* * * * *